US012582888B1

(12) United States Patent
Englefield et al.

(10) Patent No.: US 12,582,888 B1
(45) Date of Patent: Mar. 24, 2026

(54) APPARATUS AND METHOD FOR ATTACHING AN AIMING DEVICE TO A PUTTER HEAD

(71) Applicant: Putter Key, LLC, Corte Madera, CA (US)

(72) Inventors: David Englefield, Cranleigh (GB); Lawrence Alioto, Corte Madera, CA (US); Matthew Alioto, Oakland, CA (US)

(73) Assignee: Putter Key, LLC, Corte Madera, CA (US)

( * ) Notice: Subject to any disclaimer, the term of this patent is extended or adjusted under 35 U.S.C. 154(b) by 0 days.

(21) Appl. No.: 19/256,145

(22) Filed: Jun. 30, 2025

(51) Int. Cl.
*A63B 69/36* (2006.01)

(52) U.S. Cl.
CPC ..... *A63B 69/3685* (2013.01)

(58) Field of Classification Search
CPC ..... A63B 69/3685
See application file for complete search history.

(56) References Cited

U.S. PATENT DOCUMENTS 4,002,343 A * 1/1977 Eckert ..... A63B 69/3632 473/251
4,025,078 A * 5/1977 Pelz ..... A63B 69/3685 473/236
4,601,472 A * 7/1986 O'Flanagan ..... A63B 69/3685 473/240
5,478,078 A * 12/1995 Lee ..... A63B 69/3685 473/251
5,924,935 A * 7/1999 Prewitt ..... A63B 69/3685 473/236
6,464,596 B1 * 10/2002 Belding ..... A63B 69/3685 473/251
6,702,688 B2 * 3/2004 Hale ..... A63B 69/3676 473/226
7,001,284 B2 * 2/2006 Edel ..... A63B 69/3685 473/226
12,311,246 B1 * 5/2025 Arnold ..... A63B 69/3685
2006/0030419 A1 * 2/2006 Koster ..... A63B 69/3685 473/236
2006/0094521 A1 * 5/2006 Burns ..... A63B 69/3685 473/238
2013/0178300 A1 * 7/2013 Dunn ..... A63B 69/3685 473/236
2014/0155187 A1 * 6/2014 Spelman ..... A63B 69/3685 473/220

* cited by examiner

*Primary Examiner* — Eugene L Kim
*Assistant Examiner* — Christopher Glenn
(74) *Attorney, Agent, or Firm* — The Law Office of Kevin McDermott, P.L.L.C.

(57) ABSTRACT

An attachment tool for attaching an aiming device to a putter head is provided that includes a body. The body includes a flat face, a first side, and a second side. Moreover, the apparatus includes a pair of parallel arms integrally formed with the body that orthogonally extend away from the flat face of the body. The arms are separated by a distance, each arm includes a channel, and the channels face each other.

10 Claims, 9 Drawing Sheets

APPARATUS AND METHOD FOR ATTACHING AN AIMING DEVICE TO A PUTTER HEAD

BACKGROUND OF THE INVENTION

This invention relates generally to putters, and more particularly, to an apparatus and method for attaching an aiming device to a putter head.

Putting may be one of the more difficult and important aspects of golf to master and constitutes a substantial portion of golf scores. Golfers should invest substantial time in putting practice to become better putters, but most golfers do not have the time. It is generally known that most golfers desire to improve their putting.

Putting involves gently swinging the head of a putter across a golfer's body, from one side to another, to gently hit a golf ball in the direction of a hole located in the green. Typically, a golfer aims at the hole using the aiming line etched into his or her putter. After mentally establishing a desired line or path between the face of the putter, the ball and the hole, and aligning the face of the putter to putt the ball along the desired line, the golfer gently executes his or her putting stroke to strike the ball. However, many golfers have been known to inadvertently manipulate the putter handle while executing their putting stroke which causes misalignment of the putter face. As a result, more often than not the golf ball does not follow the desired path so does not go into the hole.

It is known that golfers have used many different types of devices to improve their putting. Some of the devices may be directly attached to the putter head. However, it can be difficult to quickly and properly attach such devices to a putter head. Golfers have also been known to try several times before successfully attaching a device to a putter head. Improperly attached devices may fall off the putter head and frustrate the golfer or may provide a line of sight different than the desired line or path between the face of the putter, the ball and the hole.

Thus, it would be advantageous and an improvement over the relevant technology to provide a tool for quickly, easily, and consistently attaching a device to a golf putter to facilitate maintaining proper putter face alignment while executing a putting stroke

BRIEF DESCRIPTION OF THE INVENTION

In one aspect, an attachment tool for attaching an aiming device to a putter head is provided that includes a body. The body includes a flat face, a first side, and a second side. Moreover, the apparatus includes a pair of parallel arms integrally formed with the body that orthogonally extend away from the flat face of the body. The arms are separated by a distance, each arm includes a channel, and the channels face each other.

In one embodiment, the channels are C-shaped or U-shaped.

In another embodiment, the apparatus is manufactured from at least one of plastic, nylon, aluminum, metal and wood.

In yet another embodiment each arm includes guides for guiding an aiming device horizontally and vertically into the channels.

In another embodiment, the channels are L-shaped.

In another embodiment, the interior opening includes a pair of interior parallel sides. Each interior parallel side is offset from a respective parallel side of the body.

In yet another embodiment, the body is made from plastic, aluminum, metal, wood, or a composite including any of these materials.

In another aspect, a method for attaching an aiming device to a putter head is provided that includes sliding an aiming device into an attachment tool, manipulating the attachment tool and aiming device to be proximate the putter head, and aligning the attachment tool and aiming device fitted therein with a desired location on the putter head and a front face of the attachment tool with a front face of the putter head. Moreover, the method includes positioning the front face of the attachment tool against the front face of the putter head, positioning a bottom of the aiming device against a top of the putter head, and sliding the tool orthogonally away from the front face of the putter head.

In one embodiment, the attachment tool includes a pair of parallel arms separated by a distance, each arm includes a channel, the channels face each other and the aiming device includes first and second edges. The method further includes positioning the first and second edges of the aiming device in a respective one of the channels, and sliding the edges of the aiming device in the channels. There is a loose friction fit between the aiming device and the attachment tool.

In another embodiment, the sliding step includes pushing the aiming device between the first and second arms such that the first and second edges engage with and slide within the respective one of the channels until a first end of the aiming device is flush against a front face of the body.

In yet another embodiment of the disclosure, the positioning step includes pressing the aiming device against the top of the putter head to removably attach the aiming device to the putter head.

In yet another embodiment, the aiming device includes a cut out and the putter head includes an aiming line, and the aligning step further includes aligning the cut out with the aiming line.

In yet another aspect, an attachment tool for attaching an aiming device to a putter head is provided that includes a body having a front face, a first side, and a second side. A first cantilever extends orthogonally away from the front face proximate the first side and a second cantilever extends orthogonally away from the front face proximate the second side. Each of the first and second cantilevers includes a first end, a terminus, a front surface, a rear surface, a bottom, a top, a ledge extending along the bottom, and a member extending along the top. The first cantilever front and rear surfaces extend from the first end to the terminus of the first cantilever, and the first surface, ledge, and member of the first cantilever form a first channel. The second cantilever front and rear surfaces extend from the first end to the terminus of the second cantilever. The first surface, ledge, and member of the second cantilever form a second channel, and the first and second channels face each other and are separated by a distance.

In one embodiment, the front surface of the first cantilever includes a first guide portion. The first guide portion extends from the first cantilever terminus to an end of the first cantilever member. The front surface of the second cantilever includes a first guide portion. The second cantilever first guide portion extends from the second cantilever terminus to an end of the second cantilever member.

In another embodiment, the first cantilever member includes a second guide portion. The second guide portion extends from the end of the first cantilever member towards the first channel. The second cantilever member includes a second guide portion. The second cantilever second guide portion extends from the end of the second cantilever member towards the second channel. The first guide portion of the first and second cantilevers is configured to guide an aiming device horizontally into the first and second channels, and the second guide portion of the first and second cantilever members is configured to guide the aiming device vertically into the first and second channels.

In yet another embodiment, the first guide portion of the first and second cantilever is arcuate or a straight-line taper, and the second guide portion of the first and second cantilevers is arcuate or a straight-line taper.

In yet another embodiment, the body, first cantilever, and second cantilever are manufactured from at least one of plastic, nylon, aluminum, metal and wood.

In yet another embodiment, the first and second channels are C-shaped or U-shaped.

In yet another embodiment, the first and second channels are configured to slidingly receive an aiming device, the aiming device includes a bottom surface and an adhesive on the bottom surface. The adhesive has a thickness. The thickness of the adhesive is greater than or equal to a thickness of the first cantilever ledge and the second cantilever edge.

In yet another embodiment, the body, the first cantilever, and the second cantilever are integrally formed.

DETAILED DESCRIPTION OF THE INVENTION

The following detailed description is made with reference to the accompanying drawings and is provided to assist in a comprehensive understanding of various example embodiments of the present disclosure. The following description includes various details to assist in that understanding, but these are to be regarded merely as examples and not for the purpose of limiting the present disclosure as defined by the appended claims and their equivalents. The words and phrases used in the following description are merely used to enable a clear and consistent understanding of the present disclosure. In addition, descriptions of well-known structures, functions, and configurations may have been omitted for clarity and conciseness. Those of ordinary skill in the art will recognize that various changes and modifications of the example embodiments described herein can be made without departing from the spirit and scope of the present disclosure.

Figure 1:
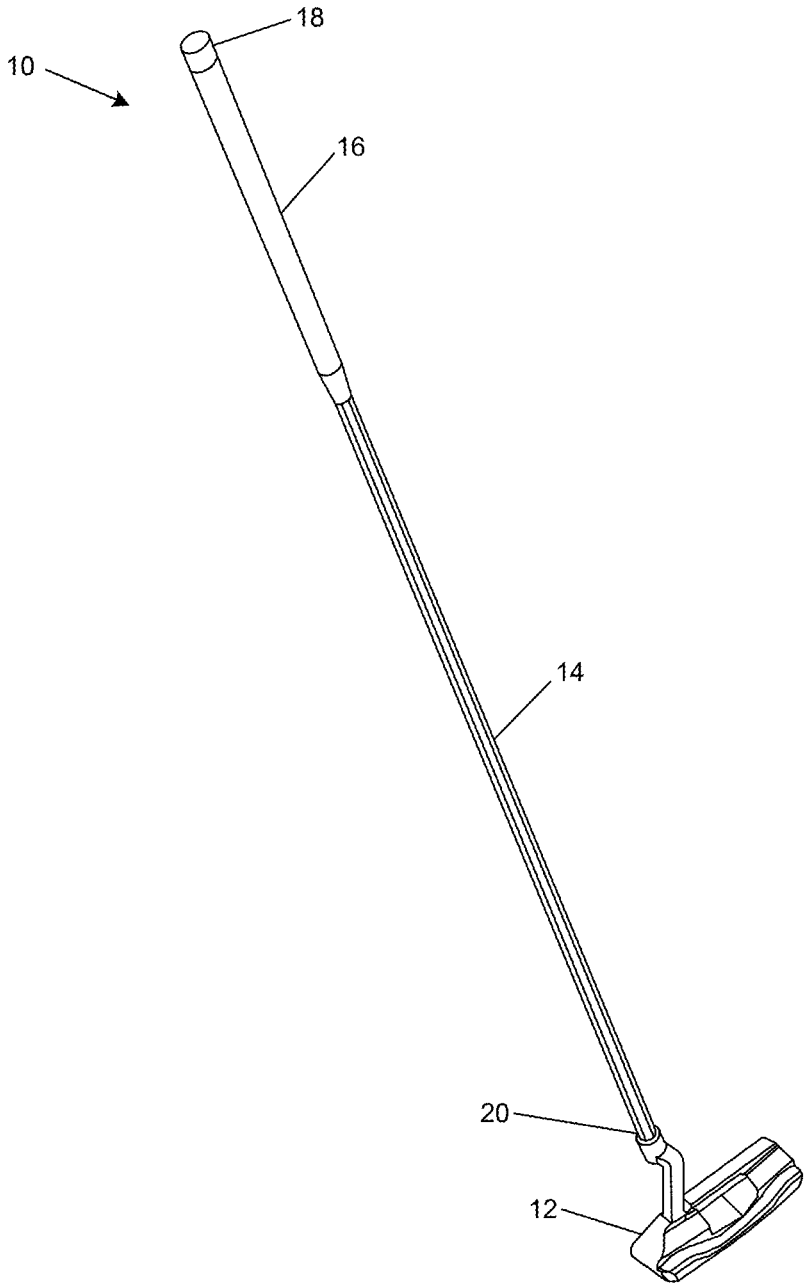
FIG. 1 is a perspective view of an example golf putter.

FIG. 1 is a perspective view of an example golf putter 10. More specifically, the putter 10 includes an example putter head 12, a shaft 14 and a gripping region 16. The putter shaft 14 includes a first end 18 and a second end 20. The putter head 12 may be fixedly attached to either the first 18 or second 20 ends while the gripping region 16 may be attached to the opposite end. The gripping region 16 is for ensuring that golfers are able to securely grasp the putter shaft 14 while putting.

Figure 2:
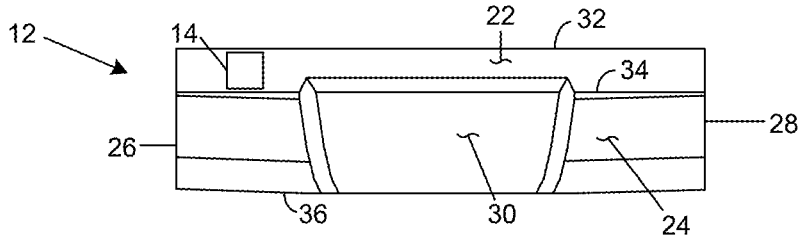
FIG. 2 is an enlarged top view of an example putter head as shown in FIG. 1.

FIG. 2 is an enlarged top view of the example putter head 12 as shown in FIG. 1. More specifically, the head 12 includes a top surface 22, a back portion 24, a heel 26, a toe 28, a recess 30, a front face 32, and a back face 34. The back portion 24 extends away from the back face 34 to define a rear edge 36 of the back portion 24. The recess 30 extends from the back face 34 to the rear edge 36. The example putter head 12 is a blade type putter head.

Figure 3:
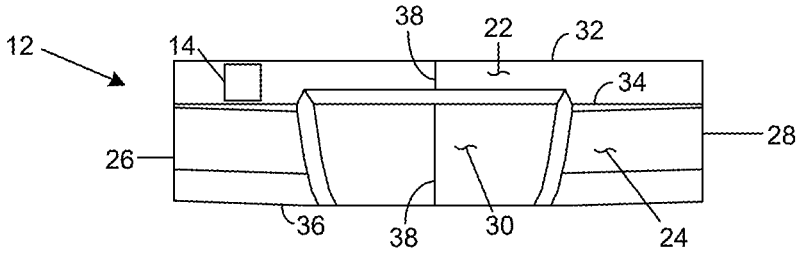
FIG. 3 is the enlarged top view of an example putter head as shown in FIG. 2, further including an aiming line.

FIG. 3 is the enlarged top view of the example putter head 12 as shown in FIG. 2, further including an aiming line 38, for example, etched therein. Alternatively, or additionally, the aiming line 38 may be, for example, etched in the top surface 22.

Although the example putter head 12 described herein is a blade type putter head, it is contemplated by the present disclosure that the putter head 12 may be any type of putter head including, but not limited to, a mallet type putter head.

Figure 4:
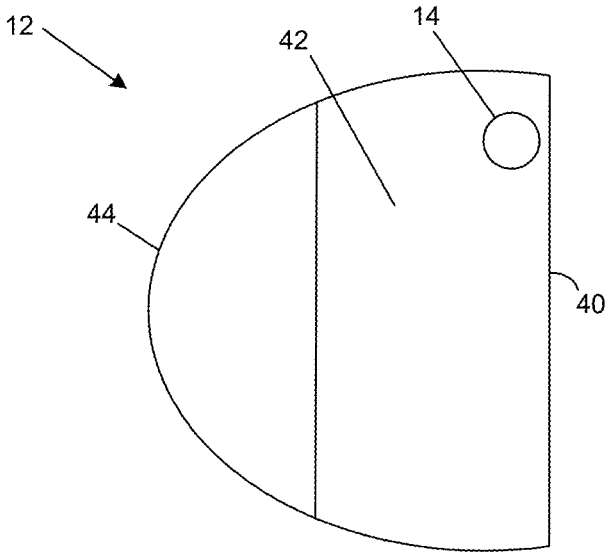
FIG. 4 is an enlarged top view of an alternative example golf putter head that can be included in the golf putter as shown in FIG. 1.

FIG. 4 is an enlarged top view of an alternative example golf putter head 12 that can be included in the golf putter 10 as shown in FIG. 1. The alternative golf putter head 12 is a mallet type putter head. Thus, the golf putter 10 can include the mallet type putter head 12 instead of the blade type putter head as shown in FIG. 1.

The mallet type putter head 12 includes the front portion 40 and a back portion 42 extending away from the front face 40 to define a rear edge 44. The back portion 42 does not include a recess and the rear edge 44 is curved. The rear edge 44 may be any type of curve including, but not limited to, a semicircle. Alternatively, the rear edge 44 may have any other geometric shape, for example, rectangular, square, and triangular.

Figure 5:
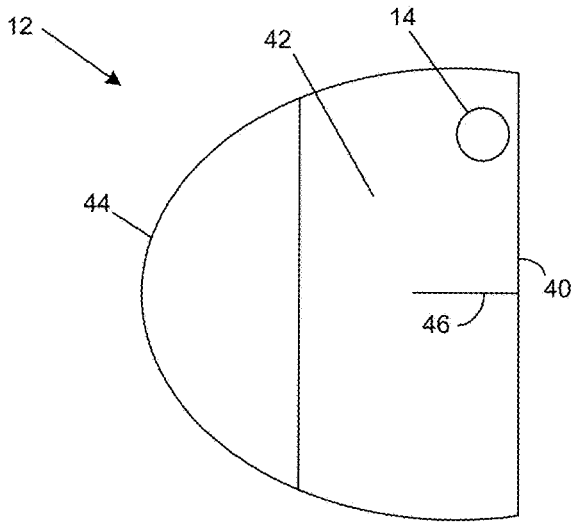
FIG. 5 is the enlarged top view of the example golf putter head as shown in FIG. 4, further including an aiming line.

FIG. 5 is the enlarged top view of the example putter head 12 as shown in FIG. 4, further including an aiming line 46, for example, etched therein. The aiming line 46 typically extends orthogonally away from the front face 40 towards the rear edge 44. The aiming lines 38, 46 may be any length that facilitates mentally establishing a desired line between the putter and the hole, for example, half of an inch. The aiming lines 38, 46 may correspond to the best location on the putter face 32 to putt a golf ball, that is, the sweet spot of the putter head 12.

Figure 6:
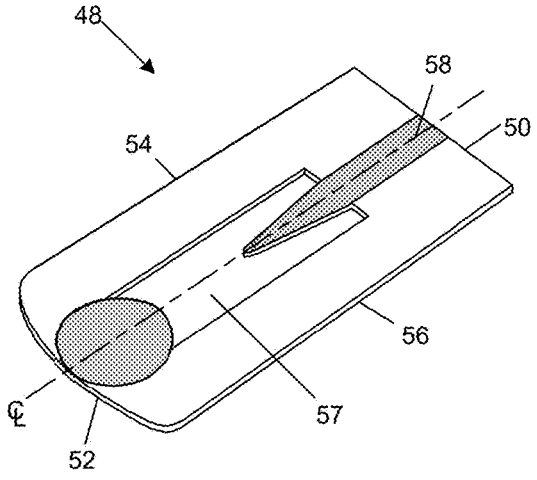
FIG. 6 is a perspective view of an example aiming device according to an embodiment of the present disclosure.

FIG. 6 is a perspective view of an example aiming device 48 according to an embodiment of the present disclosure. The aiming device 48 is generally rectangular and includes a first end edge 50, a second end edge 52, a first side edge 54 and a second side edge 56. The first 54 and second 56 side edges are parallel to each other while the first end edge 50 extends between a first end of the first 54 and second 56 side edges. The first end edge 50 may be normal to both the first 54 and second 56 side edges. The first 54 and second 56 side edges have a rectangular shape or cross-section. Alternatively, the first 54 and second 56 sides edges may have any shape or cross-section, for example, semicircular, oval and triangular that facilitates fitting the aiming device 48 into a tool as described herein. The first 54 and second 56 side edges typically have the same rectangular shape or cross-section.

The aiming device 48 includes an interior opening 57 and an aiming member 58 extending into the opening 57. The aiming member 58 is parallel to the first and second side edges 54 and 56.

Figure 7:
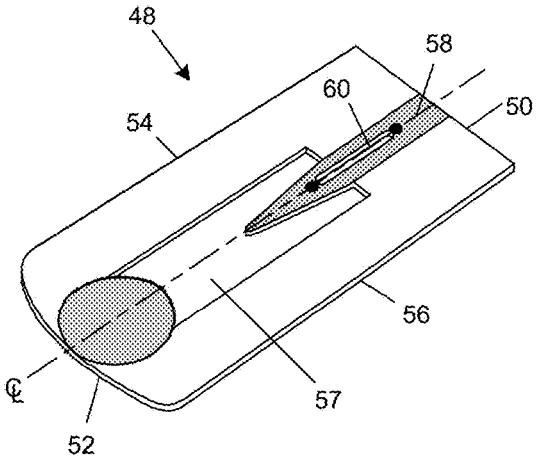
FIG. 7 is a perspective view of the example aiming device as shown in FIG. 6 further including a cut out.

FIG. 7 is the perspective view of the example aiming device 48 as shown in FIG. 6 further including an elongated cut out 60 that is parallel to the side edges 54, 56. The cut out 60 is a hole that extends through the aiming device 48 from a top surface to a bottom surface of the aiming device 48. The centerline of the aiming device 48 is also the centerline of the cut out 60.

Figure 8:
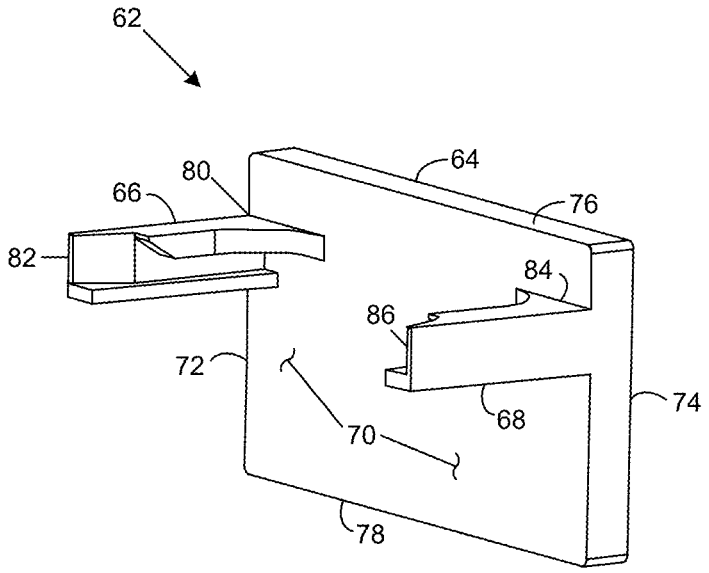
FIG. 8 is a perspective view of an example aiming device attachment tool according to an embodiment of the present disclosure.

FIG. 8 is a perspective view of an example tool 62 for attaching the aiming device 48 to the putter head 12 according to an embodiment of the present disclosure. More specifically, the tool 62 includes a body 64, a first arm 66, and a second arm 68. The body 64 is rectangular. As such, the body 64 includes a front face 70, a first side 72, a second side 74 parallel to the first side 72, a top side 76, and a bottom side 78 parallel to the top side 76. The front face 70 is flat and may alternatively be referred to as a flat surface. Although the body 64 is described herein as being rectangular, it is contemplated by the present disclosure that the body 64 may alternatively have any shape, for example, square, circular or oval.

The first arm 66 includes a first end 80 and a second end 82. The second end 82 may alternatively be referred to herein as a terminus. The first end 80 of the first arm 66 is attached to the front face 70 of the body 64. The first arm 66 is located adjacent the first side 72 and extends orthogonally away from the front face 70.

The second arm 68 is the same as the first arm 66 for all embodiments described herein. More specifically, the second arm 68 includes a first end 84 and a second end 86. The second end 86 may be alternatively referred to herein as a terminus. The first end 84 of the second arm 68 is attached to the front face 70 of the body 64. The second arm 68 is located adjacent the second side 74 and extends orthogonally away from the front face 70. The first 66 and second 68 arms may be integrally formed with the body 64. However, it is contemplated by the present disclosure that the arms 66, 68 may alternatively be removably attached to the body 64, for example, in a snap-fit relationship, via mechanical fasteners, via an adhesive, or via any other type of fastener.

The first 66 and second 68 arms are arranged symmetrically on the front face 70 of the body 64. Alternatively, the first 66 and second 68 arms may not be arranged symmetrically on the front face 70. Because the first 66 arm is located adjacent the first side 72 and the second arm 68 is located adjacent the second side 74, the arms 66, 68 are separated by a distance. The arms 66 and 68 may each alternatively be referred to herein as a cantilever.

Although the first 66 and second 68 arms each extend orthogonally away from the front face 70 of the body 64, it is contemplated by the present disclosure that the first 66 and second 68 arms may extend away from the front face 70 at other than ninety degrees. For example, each of the arms 66, 68 may extend away from the front face 70 at an angle within a range of between about eighty-five and ninety-five degrees. However, it should be understood that the angles should enable fitting the aiming device 48 in the tool 62 in a manner that allows attaching the aiming device 48 to the putter head 12 as described herein.

Figure 9:
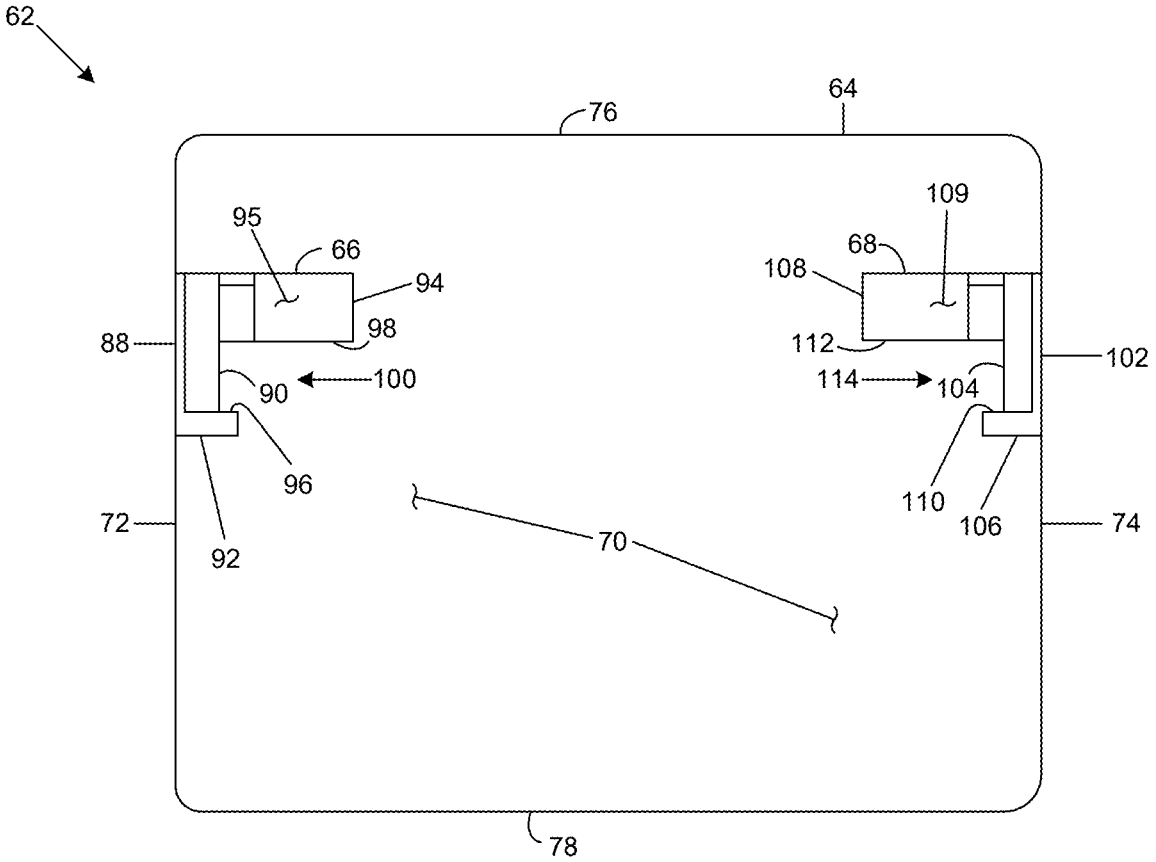
FIG. 9 is a front view of the attachment tool as shown in FIG. 4.

FIG. 9 is a front view of the tool 62 in which the first arm 66 further includes an outside surface 88, an inside surface 90, a ledge 92, and a top member 94. The outside surface 88 is flush with the first side 72 of the body 64. Alternatively, the outside surface 88 may be offset from the first side 72 by any distance, for example, one eighth of an inch. The ledge 92 extends orthogonally away from the first side 72 and includes a top surface 96. The top member 94 extends orthogonally away from the first side and includes an interior surface 95 and a bottom surface 98. The top surface 96, the inside surface 90, and the bottom surface 98 form a channel 100 to accommodate, for example, the edge 54 of the aiming device 48.

Because the first 66 and second 68 arms are the same in each embodiment described herein, the second arm 68 also includes an outside surface 102, an inside surface 104, a ledge 106, and a top member 108. The outside surface 102 is flush with the second side 74 of the body 64. Alternatively, the outside surface 102 may be offset from the second side 74 by any distance, for example, one eighth of an inch.

The ledge 106 extends orthogonally away from the second side 74 of the body 64 and includes a top surface 110. The top member 108 extends orthogonally away from the second side 74 and includes an interior surface 109 and a bottom surface 112. The top surface 110, inside surface 104, and bottom surface 112 form a channel 114 to accommodate, for example, the edge 56 of the aiming device 48. The channels 100 and 114 each have a rectangular cross section. Thus, the channels 100 and 114 may be, for example, C-shaped or U-shaped channels. However, it is contemplated by the present disclosure that the ledges 92, 106, the inside surfaces 90, 104, and the top members 94, 108 may alternatively be configured to form channels 100 and 114 that have different cross-sections to accommodate differently shaped edges 54, 56 of the aiming device 48. Such different cross sections include, for example, circular, oval and triangular. It should be understood that the channels 100 and 114 have the same cross section and face each other in each different embodiment described herein.

Figure 10:
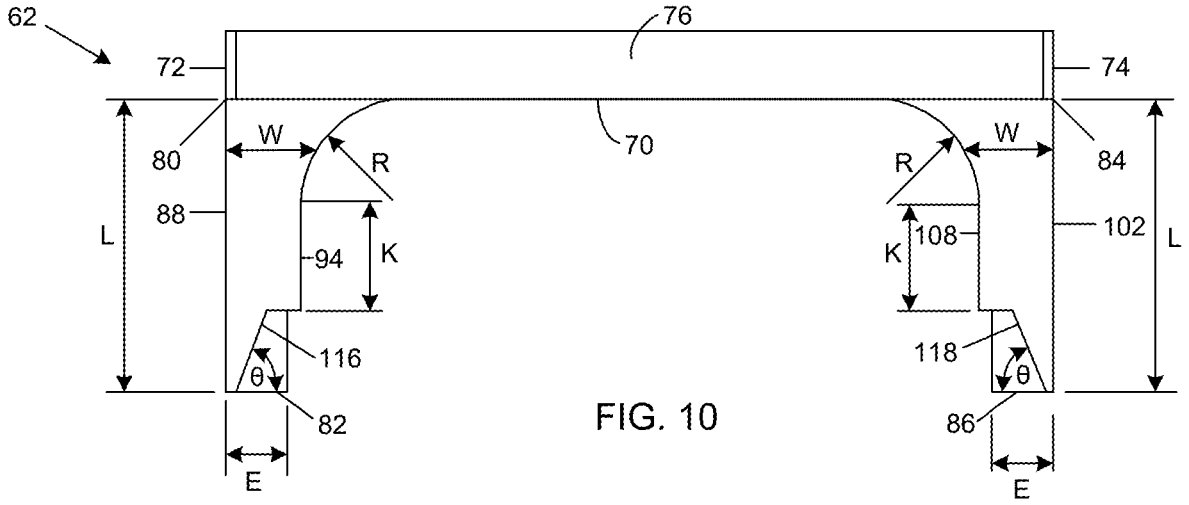
FIG. 10 is a diagram illustrating a top view of the aiming device attachment tool.

FIG. 10 is a diagram illustrating a top view of the tool 62 in which the inner surface 90 of the first arm 66 includes a guide section 116 and the inner surface 104 of the second arm 68 includes a guide section 118. The guide section 116 forms an angle theta (θ) with the second end 82 and the guide section 118 forms the same angle θ with the second end 86. The angle theta θ may be, for example, sixty degrees. However, it is contemplated by the present disclosure that the angle θ may be any angle that facilitates guiding the edges 54, 56 of the aiming device 48 into the channels 100 and 114. For example, the angle theta θ may be within a range of between about twenty and seventy degrees. Alternatively, the guide sections 116 and 118 may be, for example, arcuate.

The guide sections 116 and 118 facilitate creating a wider opening for manipulating the aiming device 48 into the tool 62 generally, and facilitate guiding the edges 54, 56 of the aiming device 48 horizontally into the channels 100 and 114.

Each of the arms 66, 68 has a length L which may be, for example, one half of an inch. However, it is contemplated by the present disclosure that the arms 66, 68 may be any length L that facilitates creating a loose friction fit between the arms 66, 68 and the edges 54, 56 of the aiming device 48 that allows the tool 62 to be easily and quickly disengaged from the aiming device 48. Thus, the length L may range, for example, from about one half of an inch to two inches.

The top members 94, 108 have a width W. The width W is constant along a length K of the members 94, 108 and varies between the constant width section and the front face 70 of the body 64. More specifically, the interior surfaces 95, 109 are defined by a radius R. As a result, the width W of the arms 66, 68 increases towards the front face 70. Increasing the width W of the arms 66, 68 at the front face 70 facilitates creating a stronger connection between the body 64 and the arms 66, 68.

The radius R may be, for example, an eighth of an inch. Alternatively, the radius R may be any size that facilitates enhancing the strength of the connection between the arms 66, 68 and the front face 70 and facilitates using the tool 62 to attach the aiming device 48 to the putter head 12 as described herein. The ledges 82, 86 each have a width E.

Figure 11:
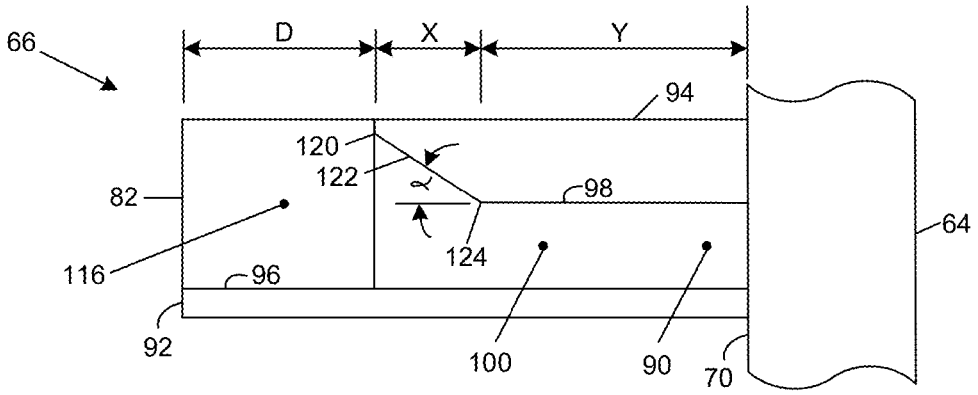
FIG. 11 is an enlarged side view of the first arm including a guide section.

FIG. 11 is an enlarged side view of the first arm 66 including the guide section 116. The guide section 116 extends a distance D from the second end 82 of the first arm 66 towards the body 64 to an end 120. The distance D may vary depending on the angle theta (θ).

The top member 94 extends from the end 120 to the front face 70 of the body 64. The top member 94 includes a second guide section 122 that extends from the end 120 a distance X towards the front face 70 to an end 124. The second guide section 122 forms an angle alpha (α) with the bottom surface 98 of the top member 94.

The angle alpha α maybe, for example, thirty degrees. However, it is contemplated by the present disclosure that the angle alpha α may be any angle that facilitates guiding the aiming device 48 vertically into the channels 100 and 114. For example, the angle alpha α may be within a range of between about twenty and seventy degrees. Alternatively, the second guide section 110 may be, for example, arcuate.

The second guide section 122 functions to guide the aiming device 48 vertically into the channel 100. The channel 100 extends from the end 124 of the second guide section 122 a distance Y to the front face 70.

Because the second arm 68 is the same as the first arm 66 for all embodiments described herein, the second arm 68 also includes a second guide section like the second guide section 122. Additionally, the channel 114 extends from an end of the second guide section a distance Y to the front face 70.

The information shown in FIG. 12 includes the same information shown in FIG. 9 as described in more detail below. As such, features illustrated in FIG. 12 that are identical to features illustrated in FIG. 9 are identified using the same reference numerals used in FIG. 9.

Figure 12:
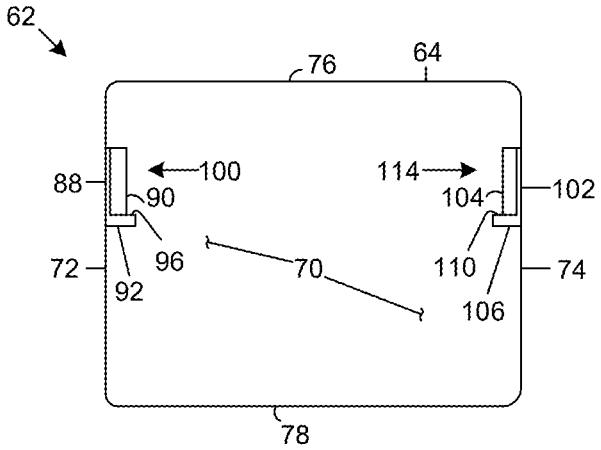
FIG. 12 is a front view of the attachment tool according to an alternative embodiment of the present disclosure.

FIG. 12 is a front view of the tool 62 as shown in FIG. 9. However, the top members 94 and 108 are not included in the first 66 and second 68 arms, respectively. As a result, the channel 100 in the first arm 66 and the channel 114 in the second arm 68 are L-shaped channels.

Figure 13:
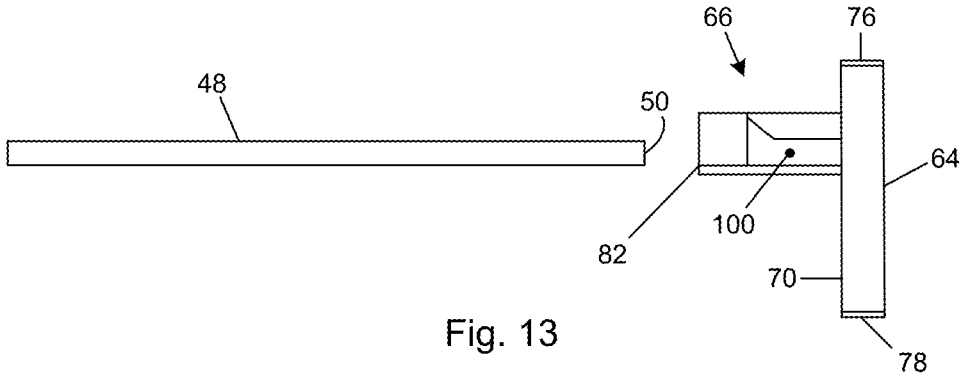
FIG. 13 is a cross-sectional view of the attachment tool and the aiming device.

FIG. 13 is a cross-sectional view of the tool 62 and of the aiming device 48 positioned to be fitted into the attachment tool 62. For example, the first end 50 of the aiming device 48 can be positioned proximate the first end 82 of the first arm 66. It should be understood, that although not shown, the first end 50 of the aiming device 48 is also positioned proximate the first end 86 of the second arm 68. The aiming device 48 is generally oriented for sliding into the channels 100 and 114. From this position, the aiming device 48 is pushed between the first arm 66 and the second arm 68 such that the second side edge 56 engages and slides within the channel 114 and the first side edge 54 engages with and slides within the channel 100 until the first end 50 is flush against the front face 70 of the body 64.

The information shown in FIG. 14 includes the same information shown in FIG. 13 as described in more detail below. As such, features illustrated in FIG. 14 that are identical to features illustrated in FIG. 13 are identified using the same reference numerals used in FIG. 14.

Figure 14:
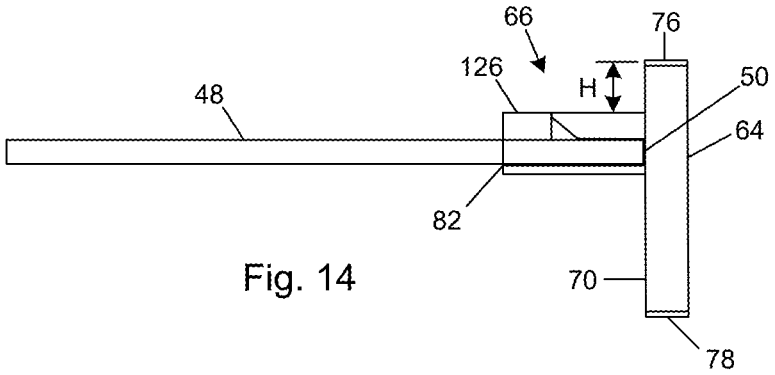
FIG. 14 is the cross-sectional side view of the attachment tool and of the aiming device as shown in FIG. 13; however, the aiming device is flush against the front face of the body.

FIG. 14 is the cross-sectional view of the tool 62 and the aiming device 48 as illustrated in FIG. 13. However, the first end 50 of the aiming device 48 is flush against the front face 70 of the body 64. It should be understood that there is a loose friction fit between the aiming device 48 and the tool 62 such that the aiming device 48 does not readily slide out of the channels 100, 114 of the tool 62, but may easily slide out of the channels 100, 114 after attaching the aiming device 48 to the putter head 12.

The first arm 66 has a top surface 126 separated from the top side 76 of the body 64 by a distance H. The part of the body 64 along the distance H may function as a handle while handling the attachment tool 50. The distance H may be, for example, one quarter of an inch. However, it is contemplated by the present disclosure that the distance H may alternatively be any distance that facilitates handling the tool 62 while installing the aiming device 48 on the putter head 12. For example, the distance H may alternatively be zero. When the distance H is zero or close to zero, the tool 62 can be handled by the sides 72 and 74, or by the sides 88, 102 of the first 66 and second 68 arms, respectively.

Figure 15:
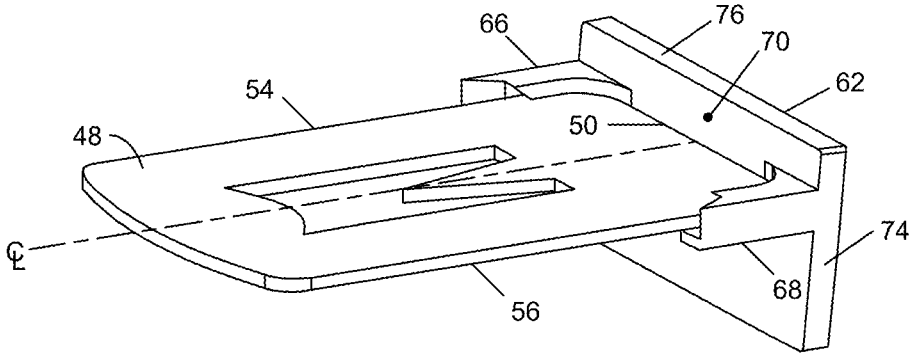
FIG. 15 is a perspective view of the aiming device 114 fitted in the attachment tool 50.

FIG. 15 is a perspective view of the aiming device 48 fitted in the tool 62. When properly fitted in the tool 62, the first 54 and second 56 side edges as well as the centerline of the aiming device 48 are normal to the front face 70. Additionally, the first end 50 is flush against the front face 70. As a result, the first end edge 50 of the aiming device 48 is also squared with the front face 32 of the putter head 12.

Figure 16:
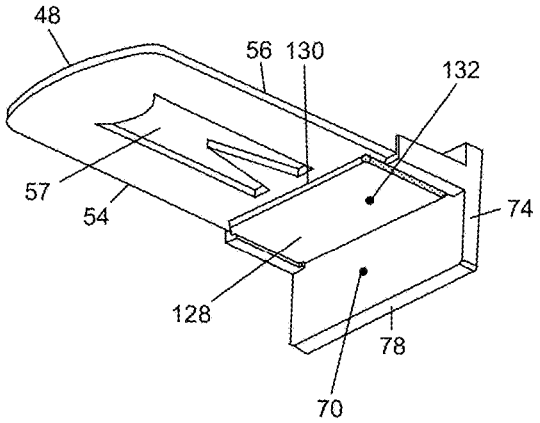
FIG. 16 is another perspective view of the aiming device fitted in the attachment tool; however, the view is of the bottom of the aiming device.

FIG. 16 is another perspective view of the aiming device 48 fitted in the tool 62. However, the view is of the bottom of the aiming device 48. An adhesive strip 128 can be applied to the bottom of the aiming device 48. The adhesive strip 128 can extend from the first end 50 of the aiming device 48 to roughly just before the interior opening 57, between the first side edge 54 and the second side edge 56, and away from the bottom of the aiming device 48. The adhesive strip should not cover the interior opening 57.

The adhesive strip 128 includes a bottom surface 132 coated with an adhesive that facilitates attaching the aiming device 48 to the putter head 12 and easily removing the aiming device 48 from the putter head 12. Thus, the aiming device 48 is removably attached to the putter head 12. It is contemplated by the present disclosure that the aiming device 48 may be repeatedly attached to and removed from the putter head 12. Thus, the adhesive should be an adhesive that can be used to repeatedly securely attach the aiming device 48 to, and repeatedly remove the aiming device 48 from the putter head 12. The aiming device 48 may be attached and removed from the putter head 12, for example, tens or hundreds of times.

For aiming devices 48 that include the cut out 60, the adhesive strip should not be cover the cut out 60. Thus, the adhesive strip 128 should include a cut out (not shown) so the adhesive strip 128 does not cover any part of the cut out 60.

Although an adhesive strip 128 is used to removably attach the aiming device 48 to the putter head 12, it is contemplated by the present disclosure that the aiming device 48 may alternatively be removably attached to the putter head 12 in any manner, for example, using Velcro.

Figure 17:
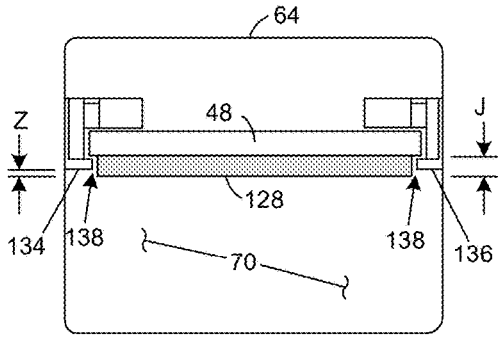
FIG. 17 is a front view of the attachment tool with the aiming device fitted therein.

FIG. 17 is a front view of the tool 62 with the aiming device 48 fitted therein. The adhesive strip 128 extends away from the bottom surface of the aiming device 48 by a distance J and from a bottom 134, 136 of the ledges 92, 106, respectively, by a distance Z. When the adhesive strip 128 does not extend beyond the bottoms 134, 136 the distance Z is less than zero. As a result, the adhesive strip 128 will not adhere to the surface of the putter head 12 when attempting to attach the aiming device 48 to the putter head 12. Thus, it should be understood that the adhesive strip 128 should extend from the bottom of the aiming device 48 to at least the bottoms 134, 136 of the aiming device 48. Additionally, the adhesive strip 128 should be positioned on the bottom of the aiming device 48 so there is a gap 138 between each ledge 92, 106 and the adhesive strip 128. The gap 138 facilitates smoothly, easily and quickly inserting the aiming device 48 into the tool 62 and smoothly, quickly and easily removing the tool 62 from the aiming device 48.

Figure 18:
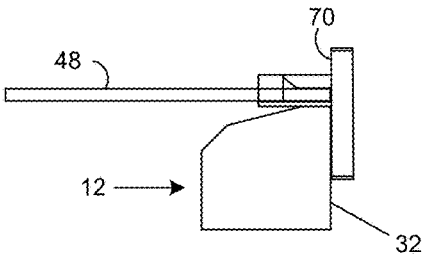
FIG. 18 is a cross-sectional view of the aiming device attached to the top of the putter head while also being fitted in the attachment tool.

FIG. 18 is a cross-sectional view of the aiming device 48 attached to the top of the putter head 12 while also being fitted in the tool 62. After the aiming device 48 is fitted into the tool 62, the aiming device 48 and the tool 62 are positioned proximate the putter head 12 and manipulated to align the tool 62 with a desired location on the putter head 12. The desired location may be, for example, a location deemed to be the so-called sweet spot of the putter head 12. It is contemplated by the present disclosure that when the putter head 12 includes the aiming line 38 and the aiming device 48 includes a cut out 60, the tool 62 with the aiming device 48 fitted therein may alternatively be manipulated to align the cut out 60 with the aiming line 38 and the front face 70 of the body 64 with the front face 32 of the putter head 12.

Next, the front face 70 is pressed against the front face 32 and the aiming device 48 is pressed against the top 22 of the putter head 12. The aiming device 48 is removably attached to the putter head 12 via the adhesive strip 128. The tool 62 is disengaged from the aiming device 48 by sliding the tool 62 off of the aiming device 48 in a direction normal to the front face 32.

By virtue of attaching the aiming device 48 to the putter head 12 using the tool 62, the first end edge 50 of the aiming device 48 is parallel to the front face 32 of the putter head 12. As a result, the first end edge 50 of the aiming device 48 is also parallel to, or squared with the front face 32 of the putter head 12. Thus, the aiming member 58, the first side edge 54 and the second side edge 56 are normal to the front face 32, which alignment facilitates enhancing putting performance. Using the tool 62 as described herein facilitates quickly, easily and consistently attaching the aiming device 48 to the sweet spot of the putter head 12 such that the front end edge 50 of the aiming device 48 is square with the front face 32 of the putter head 12. Thus attached, the aiming device 48 facilitates maintaining proper putter face alignment while executing a putting stroke. As a result, putting performance is facilitated to be enhanced.

Figure 19:
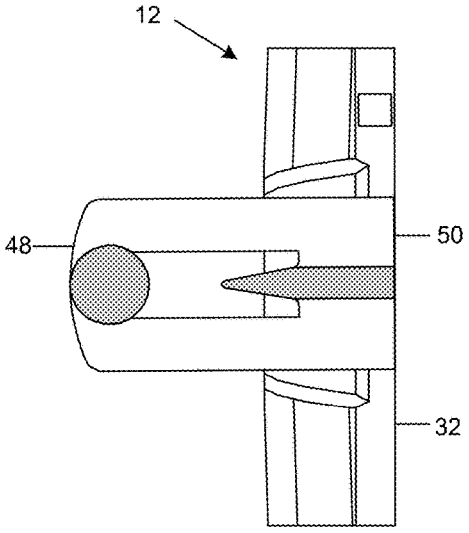
FIG. 19 is a top view of the aiming device removably attached to the putter head.

FIG. 19 is a top view of the aiming device 48 removably attached to the putter head 12.

Figure 20:
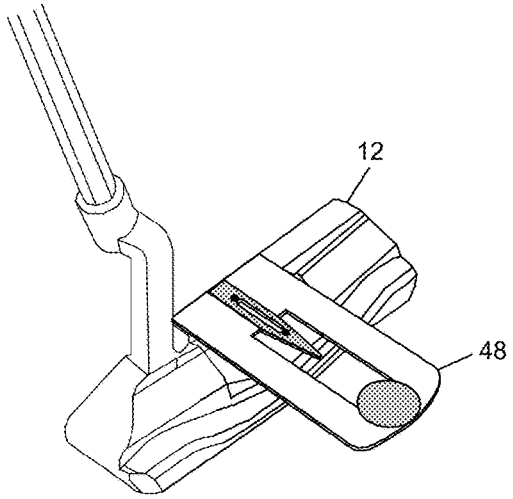
FIG. 20 is a perspective view of the aiming device removably attached to the putter head.

FIG. 20 is a perspective view of the aiming device 48 removably attached to the putter head 12.

Figure 21:
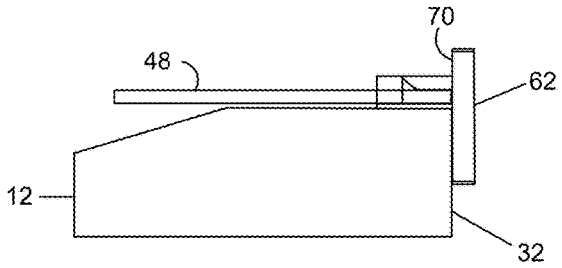
FIG. 21 is a cross-sectional view of the putter head with the attachment tool and aiming device as shown in FIG. 18; however, the putter head is a mallet type putter head.

FIG. 21 is a cross-sectional view of the aiming device 48 attached to the top of the putter head 12 while also being fitted in the tool 62, similar to that shown in FIG. 18. However, the putter head 12 is a mallet type putter head. The tool 62 is used to attach the aiming device 48 to the putter head 12 as described herein with regard to FIG. 18.

Figure 22:
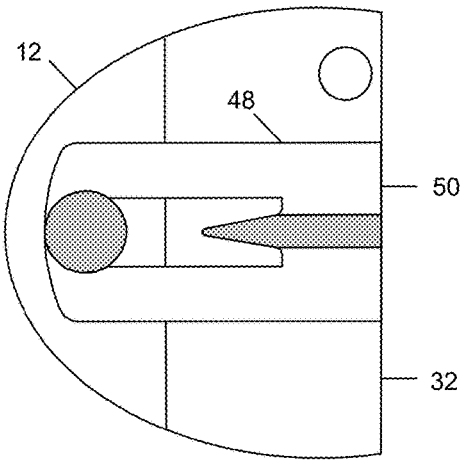
FIG. 22 is a top view of the aiming device removably attached to the mallet type putter head shown in FIG. 18.

FIG. 22 is a top view of the aiming device 114 removably attached to the mallet type putter head 12.

Figure 23:
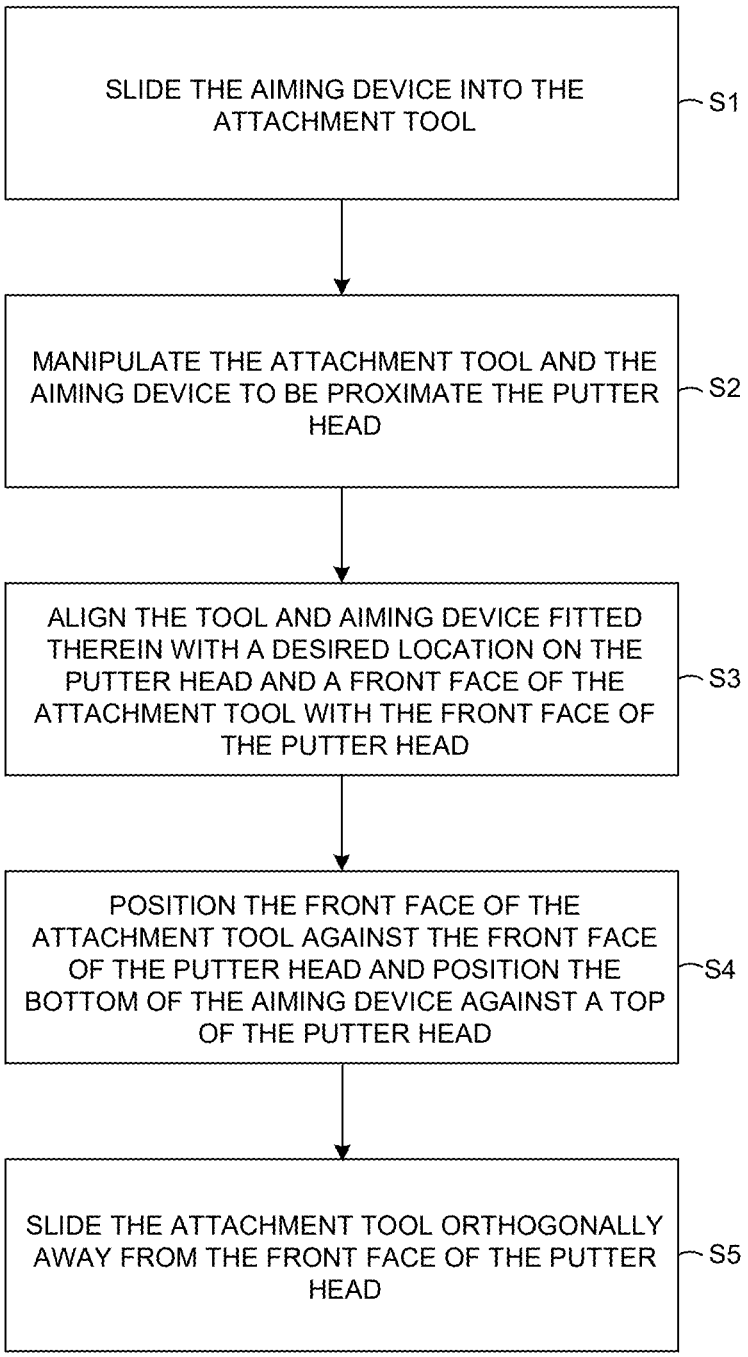
FIG. 23 is a flowchart illustrating an example method for attaching an aiming device to a putter head using an attachment tool according to an embodiment of the present disclosure.

FIG. 23 is a flowchart illustrating an example method of using the attachment tool 62 to attach an aiming device to a putter head according to an embodiment of the present disclosure. FIG. 23 illustrates example steps performed by a golfer before executing a putting stroke.

In step S1, a golfer slides the aiming device 48 into the tool 62 to achieve a loose friction fit between the aiming device 48 and the tool 62. For example, the golfer can position the first end 50 of the aiming device 48 proximate the first ends 82, 86 of the first 66 and second 68 arms, respectively. The aiming device 48 can be generally oriented for sliding into the channels 100 and 114. From this position, the aiming device 48 is pushed between the first 66 and second 68 arms such that the second side edge 56 engages and slides within the channel 114 and the first side edge 54 engages with and slides within the channel 100 until the first end 50 is flush against the front face 70 of the body 64.

It should be understood that there is a loose friction fit between the aiming device 48 and the tool 62 such that the aiming device 48 does not readily slide out of the channels 100, 114 of the tool 62, but may be easily slid out of the channels 100, 114 after attaching the aiming device 48 to the putter head 12.

Next, in step S2, the golfer manipulates the tool 62 and the aiming device 48 fitted therein to be proximate the putter head 12. As the golfer manipulates the tool 62 and aiming device 48, in step S3, the golfer aligns the tool 62 with the aiming device 48 fitted therein with a desired location on the putter head and aligns the front face 70 of the tool 62 with the front face 32 of the putter head 12. The desired location may be, for example, a location deemed to be the so-called sweet spot on the putter head 12.

In step S4, the golfer positions the front face 70 of the tool 62 against the front face 32, positions a bottom of the aiming device 48 against a top surface of the putter head 12, and presses the aiming device 48 against the putter head 12. As a result, the adhesive strip 128 adheres to the putter head 12 to thus removably attach the aiming device 48 to the putter head 12.

By virtue of attaching the aiming device 48 to the putter head 12 using the tool 62, the first end edge 50 of the aiming device 48 is facilitated to be parallel to the front face 32 of the putter head 12. As a result, the first end edge 50 of the aiming device 48 is parallel to, or squared with the front face 32 of the putter head 12. Thus, the aiming member 58, the first side edge 54 and the second side edge 56 are normal to the front face 32. Thus attached, the aiming device 48 facilitates enhancing putting performance.

Next, in step S5, the golfer slides the tool 62 orthogonally away from the front face 32 of the putter head 12 to disengage the attachment tool 62 from the aiming device 48.

Although the tool 62 and aiming device 48 fitted therein are aligned with a desired location on the putter head 12 in the example method, it is contemplated by the present disclosure that the tool 62 and aiming device 46 fitted therein may alternatively be aligned with, for example, an aiming line in the putter head 12. For example, when the putter head 12 includes the aiming line 38 and the aiming device 48 includes a cut out 60, the tool 62 with the aiming device 48 fitted therein may alternatively be manipulated to align the cut out 60 with the aiming line 38 and the front face 70 of the body 64 with the front face 32 of the putter head 12. Doing so, facilitates positioning the aiming device 48 at a position on the putter head 12 that facilitates enhancing putter performance.

Using the attachment tool 62 as described herein facilitates quickly, easily and consistently removably attaching the aiming device 48 to the putter head 12 such that the front end edge 50 of the aiming device 48 is square to the front face 32 of the putter head 12, which facilitates maintaining proper putter face alignment while executing the forward swing during putting. As a result, putting performance is facilitated to be enhanced.

The tool and method of attaching an aiming device to a putter head as described herein facilitate quickly, easily and consistently attaching an aiming device to a putter to facilitate maintaining proper putter face alignment during putting which immediately enhances a golfer's aim and thus the accuracy of putting for any golfer including professionals and amateurs. As a result, the number of putts required to navigate the golf ball into the hole is facilitated to be reduced and golfers have more time to work on other areas of their golf games that they may enjoy more than putting. Accordingly, golfer performance and competitiveness are both facilitated to be enhanced.

The above description provides examples, and is not limiting of the scope, applicability, or configuration set forth in the claims. Changes may be made in the function and arrangement of elements discussed without departing from the spirit and scope of the disclosure. Various embodiments may omit, substitute, or add various features as appropriate. For instance, features described with respect to certain embodiments may be combined in other embodiments.

What is claimed is:

1. A method for attaching an aiming device to a putter head, wherein an attachment tool includes a pair of parallel arms separated by a distance, each arm includes a channel, the channels face each other and the aiming device includes first and second edges, said method comprising the steps of:

positioning the first and second edges of the aiming device in a respective one of the channels;

sliding the edges of the aiming device in the channels, wherein there is a loose friction fit between the aiming device and the attachment tool;

manipulating the attachment tool and aiming device to be proximate the putter head;

aligning the attachment tool and aiming device fitted therein with a desired location on the putter head and a front face of the attachment tool with a front face of the putter head;

positioning the front face of the attachment tool against the front face of the putter head and positioning a bottom of the aiming device against a top of the putter head; and sliding the tool orthogonally away from the front face of the putter head.

2. The method according to claim 1, said sliding step comprising pushing the aiming device between the first and second arms such that the first and second edges engage with and slide within the respective one of the channels until a first end of the aiming device is flush against a front face of the body.

3. The method according to claim 1, said positioning step further comprising pressing the aiming device against the top of the putter head to removably attach the aiming device to the putter head.

4. The method according to claim 1, wherein the aiming device includes a cut out and the putter head includes an aiming line, said aligning step further comprising aligning the cut out with the aiming line.

5. An attachment tool for attaching an aiming device to a putter head comprising:

a body having a front face, a first side, and a second side;

a first cantilever extending orthogonally away from the front face proximate the first side;

a second cantilever extending orthogonally away from the front face proximate the second side; and each of the first and second cantilevers includes a first end, a terminus, a front surface, a rear surface, a bottom, a top, a ledge extending along the bottom, and a member extending along the top, wherein the first cantilever front and rear surfaces extend from the first end to the terminus of the first cantilever, the front surface, ledge, and member of the first cantilever form a first channel, the second cantilever front and rear surfaces extend from the first end to the terminus of the second cantilever, the front surface, ledge, and member of the second cantilever form a second channel, the first and second channels face each other and are separated by a distance, the front surface of the first cantilever includes a first guide portion, the first guide portion extends from the first cantilever terminus to an end of the first cantilever member, the front surface of the second cantilever includes a first guide portion, the second cantilever first guide portion extends from the second cantilever terminus to an end of the second cantilever member, the first cantilever member includes a second guide portion, the second guide portion extends from the end of the first cantilever member towards the first channel, the second cantilever member includes a second guide portion, the second cantilever second guide portion extends from the end of the second cantilever member towards the second channel, the first guide portion of the first and second cantilevers is configured to guide an aiming device horizontally into the first and second channels, and the second guide portion of the first and second cantilever members is configured to guide the aiming device vertically into the first and second channels.

6. The attachment tool according to claim 5, wherein:

the first guide portion of the first and second cantilevers is arcuate or a straight-line taper; and the second guide portion of the first and second cantilevers is arcuate or a straight-line taper.

7. The attachment tool according to claim 5, wherein the body, first cantilever, and second cantilever are manufactured from at least one of plastic, nylon, aluminum, metal and wood.

8. The attachment tool according to claim 5, wherein the first and second channels are C-shaped or U-shaped.

9. The attachment tool according to claim 5, wherein:

the first and second channels are configured to slidingly receive an aiming device;

the aiming device includes a bottom surface and an adhesive on the bottom surface, the adhesive has a thickness; and the thickness of the adhesive is greater than or equal to a thickness of the first cantilever ledge and the second cantilever edge.

10. The attachment tool according to claim 5, wherein the body, the first cantilever, and the second cantilever are integrally formed.

* * * * *